US011364519B2

(12) United States Patent
Li

(10) Patent No.: US 11,364,519 B2
(45) Date of Patent: Jun. 21, 2022

(54) GLUE GUN

(71) Applicants: HANGZHOU UNITED TOOLS CO., LTD., Hangzhou (CN); HANGZHOU GREAT STAR INDUSTRIAL CO., LTD., Hangzhou (CN)

(72) Inventor: Yueming Li, Hangzhou (CN)

(73) Assignees: HANGZHOU UNITED TOOLS CO., LTD., Hangzhou (CN); HANGZHOU GREAT STAR INDUSTRIAL CO., LTD., Hangzhou (CN)

( * ) Notice: Subject to any disclaimer, the term of this patent is extended or adjusted under 35 U.S.C. 154(b) by 236 days.

(21) Appl. No.: 16/627,142

(22) PCT Filed: Jan. 4, 2019

(86) PCT No.: PCT/CN2019/070422
§ 371 (c)(1),
(2) Date: Dec. 27, 2019

(87) PCT Pub. No.: WO2020/140272
PCT Pub. Date: Jul. 9, 2020

(65) Prior Publication Data

US 2021/0331200 A1 Oct. 28, 2021

(51) Int. Cl.
*B05C 17/01* (2006.01)

(52) U.S. Cl.
CPC ..... *B05C 17/0126* (2013.01); *B05C 17/0136* (2013.01)

(58) Field of Classification Search
CPC ..... B05C 17/0126
(Continued)

(56) References Cited

U.S. PATENT DOCUMENTS 4,339,058 A * 7/1982 Wendt ..... G01F 11/026 222/309
5,197,635 A * 3/1993 Chang ..... B05C 17/00553 222/137
(Continued)

FOREIGN PATENT DOCUMENTS

CN 101099961 A 1/2008
CN 107116010 A 9/2017
(Continued)

OTHER PUBLICATIONS

PCT; App. No. PCT/CN2019/070422; International Search Report dated Apr. 3, 2019.

*Primary Examiner* — Jeremy Carroll
(74) *Attorney, Agent, or Firm* — Fitch, Even, Tabin & Flannery, LLP

(57) ABSTRACT

The present invention provides a glue gun, comprising a movable handle and a fixed handle, wherein the movable handle is connected to fixed handle via a pivot pin shaft; the movable handle is further provided with an actuating member, and the actuating member is provided with an actuating part cooperating with a push member; and a spacing between the pivot pin shaft and the actuating part is sized to be switchable between two or more gears, such that the magnitude of the force applied by the actuating member on the push member is changed. The gear in the present invention can be adjusted to enable switching between a fast feed and a powerful feed, thereby enabling a user to make adjustment according to actual requirements.

8 Claims, 7 Drawing Sheets

(58) Field of Classification Search
USPC ..... 222/391
See application file for complete search history.

(56) References Cited

U.S. PATENT DOCUMENTS

| | | | | |
|---|---|---|---|---|
| 6,056,156 | A | 5/2000 | Peng | |
| 6,640,998 | B1 * | 11/2003 | Kern | B05C 17/0106 222/391 |
| 2002/0092871 | A1 * | 7/2002 | Rickard | A61B 17/8822 222/327 |
| 2009/0134187 | A1 * | 5/2009 | Hefele | B05C 17/0126 222/391 |
| 2012/0145749 | A1 * | 6/2012 | Hung | B05C 17/0123 222/391 |
| 2017/0348724 | A1 * | 12/2017 | Hung | B05C 17/013 |
| 2019/0299244 | A1 * | 10/2019 | Xia | B05C 17/0052 |

FOREIGN PATENT DOCUMENTS

| | | | |
|---|---|---|---|
| CN | 207138230 | U | 3/2018 |
| CN | 108580210 | A | 9/2018 |

* cited by examiner

GLUE GUN

CROSS-REFERENCE TO RELATED APPLICATIONS

This application is a U.S. national phase application of International Application No. PCT/CN2019/070422, filed Jan. 4, 2019, designating the United States.

FIELD OF THE INVENTION

The present invention relates to the field of hardware, and in particular to a glue gun, which belongs to the technical field of tools for use in production, processing, manufacturing and construction industries.

DESCRIPTION OF THE PRIOR ART

During the use of a glue gun, glue is pushed by a gun-type handle lever, which continuously reciprocates to squeeze the glue such that the glue is discharged. One end of the glue gun is provided with a trigger mechanism suitable for a user to hold and press. As the user manually presses the trigger mechanism, the glue placed in the glue gun can be driven by a mechanical structure of the glue gun such that the glue is discharged at a glue outlet of a glue barrel. One glue gun can be adapted to various types of glue with different characteristics, and different glue has different fluidity. A common glue gun only has a fixed squeezing mechanism, so it is very difficult to achieve uniform glue discharge in the process of glue application. In specific application scenarios of the glue gun, different glue discharge speeds are required owing to different ranges of glue application. However, the common glue gun only has the fixed squeezing mechanism, so the glue discharge speed of the glue barrel can be controlled only by means of the pressing speed of the user's hand. In fact, it is extremely difficult to control the pressing speed of the user's hand while applying a force, especially when applying a large force to the handle. In the process of starting to use the glue gun, usually, since the glue is left unused for a long time, some of the glue is solidified, and the static viscosity of the glue and other problems exist, a relatively large force is usually required to drive the glue gun in the beginning of using the glue gun, and after the glue discharge is stabilized, the driving force required by the glue gun will be significantly reduced. The fixed squeezing mechanism of the common glue gun cannot solve these problems. In addition, in order to discharge the glue, usually squeezing hard in the beginning of using the glue gun, but the squeezing speed is difficult to control, so there is the problem of glue waste caused by excessive extrusion after the glue is squeezed out.

Therefore, a person skilled in the art is dedicated to developing a glue gun, in which the gear can be adjusted to enable switching between a fast feed and a powerful feed, thereby enabling the user to make adjustment according to actual requirements.

SUMMARY OF THE INVENTION

In view of the above defects in the prior art, the technical problem to be solved by the present invention is how to make gears of the glue gun adjustable.

In order to achieve the above-mentioned object, the present invention provides a glue gun, wherein the glue gun comprises a movable handle and a fixed handle, and the movable handle is connected to fixed handle via a pivot pin shaft; the movable handle is further provided with an actuating member, and the actuating member is provided with an actuating part cooperating with a push member; and a spacing between the pivot pin shaft and the actuating part is sized to be switchable between two or more gears, such that the magnitude of the force applied by the actuating member on the push member is changed.

Further, the movable handle is provided with a sliding groove, which is provided with two or more gears; and the pivot pin shaft is arranged to be slidable in the sliding groove so as to enable switching between the gears.

Further, the fixed handle is provided with a sliding groove, which is provided with two or more gears; and the pivot pin shaft is arranged to be slidable in the sliding groove so as to enable switching between the gears.

Further, an elastic component is further provided between the movable handle and the fixed handle; and the elastic component is arranged to produce a pre-tightening force on the movable handle so as to keep the pivot pin shaft in one of the gears.

Further, the pivot pin shaft is a stepped pin shaft having a pressing end, the pressing end is sheathed with an elastic component, the stepped pin shaft has a first shaft diameter portion and a second shaft diameter portion, the shaft diameter of the first shaft diameter portion is greater than the width of the sliding groove, the shaft diameter of the second shaft diameter portion is smaller than the width of the sliding groove, and the stepped pin shaft is arranged to: under the biasing action of the elastic component, the first shaft diameter portion is in the gear; when the pressing end is pressed down, the stepped pin shaft moves axially such that the second shaft diameter portion to goes into the gear; and when the pressing end is released, the stepped pin shaft moves axially in the opposite direction under the action of a restoring force of the elastic component such that the first shaft diameter portion goes into the gear again.

Further, the sliding groove is an arc-shaped groove or a linear groove.

Further, the movable handle is provided with a sliding groove, which is provided with two or more gears; and the actuating part is arranged to be slidable in the sliding groove so as to enable switching between the gears.

Further, the actuating member further comprises a pivot, and the actuating part of the actuating member is arranged to be slidable in the sliding groove around the pivot.

Further, a brake is sheathed on a push rod, one end of the brake cooperates with a limiting groove of a main body, and the one end of the brake moves between a first limiting end and a second limiting end of the limiting groove, so that the push rod has an idle stroke, with a distance from the first limiting end to the second limiting end, in the pushing process.

Further, the idle stroke is 3-5 mm.

Compared with the prior art, the beneficial effects of the present invention are as follows: 1) when the pivot pin shaft is close to the actuating part, the force of the actuating part acting on the push member is increased, which is suitable for glue with a poor fluidity; and when the pivot pin shaft is far away from the actuating part, the force of the actuating part acting on the push member is reduced, which is suitable for glue with a good fluidity; 2) the arrangement of the elastic component between the movable handle and the fixed handle can prevent the pivot pin shaft from automatically jump to other gears when a gripping force is applied on the movable handle, playing the role of fixing the gear; 3) under the biasing action of the elastic component, the stepped pin shaft can be pressed to easily realize multi-gear shifting; 4)

the gear can be adjusted to enable switching between a fast feed and a powerful feed, thereby enabling the user to make adjustment according to actual requirements; and 5) the idle stroke is set such that the internal stress of the glue in a glue barrel is released, thereby preventing the glue from flowing out of a glue outlet.

The concept, specific structure and resulting technical effect of the present invention are further described below in conjunction with the drawings to fully understand the object, features and effects of the present invention.

DETAILED DESCRIPTION OF THE PREFERRED EMBODIMENTS

Figure 1:
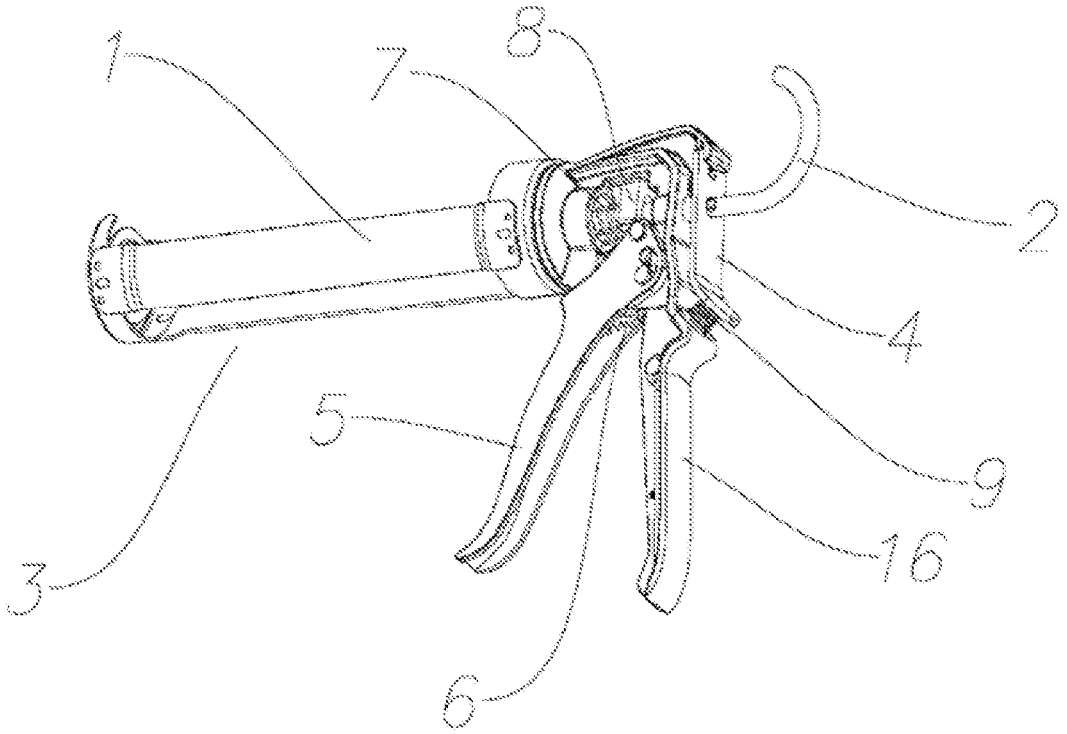
FIG. 1 is a schematic diagram showing the structure of a glue gun according to a preferred embodiment of the present invention.

Preferred embodiments of the present invention are described below with reference to the drawings of the description to make the technical contents clearer and easier to understand. The present invention can be embodied in various forms of embodiments, and the scope of protection of the present invention is not limited to the embodiments mentioned herein.

In the drawings, the same reference numeral indicates components having the same structure, and similar reference numerals indicate assemblies having similar structures or functions throughout. The size and thickness of each assembly shown in the figures are shown arbitrarily, and the present invention does not define the size and thickness of each assembly. In order to make the illustration clearer, the thickness of the component in some places of the figures is appropriately exaggerated.

Figure 2:
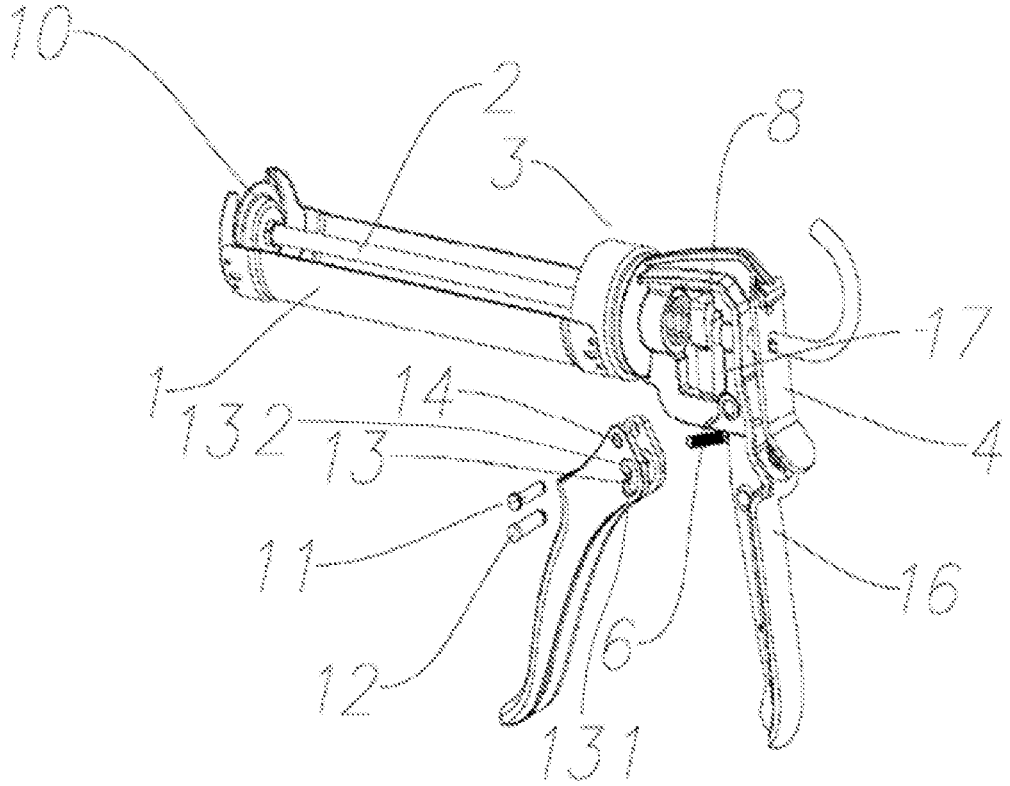
FIG. 2 is an exploded schematic diagram showing a partial structure of the glue gun in FIG. 1.

FIGS. 1-4 show a preferred embodiment of the present invention, and as shown in FIGS. 1 and 2, a glue gun of this embodiment comprises a push device, a main body 3 and a trigger device. An accommodation part 1 is formed at one end of the main body 3, and the accommodation part 1 is arranged in the shape of a cylinder so as to accommodate a glue cylinder. The other end of the main body 3 and the trigger device are hinged via a fastener or are integrally formed to form a gun-shaped fixed handle 16.

The push device comprises a push member 8, a push rod 2 and a push body 10. A first end of the push rod 2 is arranged in the accommodation part 1, and the push body 10 is fixed to an end portion of the first end of the push rod 2 and can reciprocate along with the push rod 2. A second end of the push rod 2 is sheathed with the push member 8, and a restoring spring 7 is also provided between the push member 8 and the main body 3. The trigger device pushes the push member 8 such that the push rod 2 moves in the direction of the push body 10, and the restoring spring 7 restores the push rod 8. The push rod 2 is also provided with a brake 4, and a compression spring 9 is provided between the brake 4 and the main body 3. The stop 4 retains the push rod 2 under the push of the compression spring 9, so that the push rod 2 can only move in the direction of the push body 10. When the glue cylinder needs to be installed, the brake 4 is pressed to release the push rod 2, so as to adjust the position of the push rod 2. The brake 4 cooperates with a limiting groove of the main body 3, and one end of the brake 4 moves between a first limiting end and a second limiting end of the limiting groove. When the glue is being fed, the brake 4 moves from the second limiting end to the first limiting end. At this time, the push rod 2 is pushed towards the glue barrel by an idle stroke, which is the distance between the first limiting end and the second limiting end, and preferably, the distance of the idle stroke is 3-5 mm. When the glue feeding is finished, a movable handle 5 is released, the brake 4 then moves from the first limiting end to the second limiting end so as to release the force from the movable handle 5 to the push rod 2, so that the internal stress of the glue inside the glue barrel is released, thereby preventing the glue from flowing out of a glue outlet.

The trigger device comprises the movable handle 5 and the fixed handle 16. The movable handle 5 is connected to the fixed handle 16 via a pivot pin shaft 12. The movable handle 5 is further provided with an actuating member 11, and the actuating member 11 passes through a hole 14 in the movable handle 5 and makes contact with the push member 8. The movable handle 5 is provided with a sliding groove 13, and the sliding groove 13 is of an arc-shaped structure and has two gears 131, 132. The pivot pin shaft 12 can slide in the sliding groove 13. A tension spring 6 is provided between the movable handle 5 and the fixed handle 16, and the tension spring 6 produces a pre-tightening force on the movable handle 5, so that the pivot pin shaft 12 is kept in one of the gears. When a gripping force is applied to the movable handle 5, the pivot pin shaft 11 pushes the push member 8 to move the push rod 2. When the applied force is removed, the brake 4 locks the push rod 2, and under the action of the restoring spring 7, the push member 8 slides and restores to an initial position relative to the main body 3, so that the next cycle can be carried out.

Figure 3:
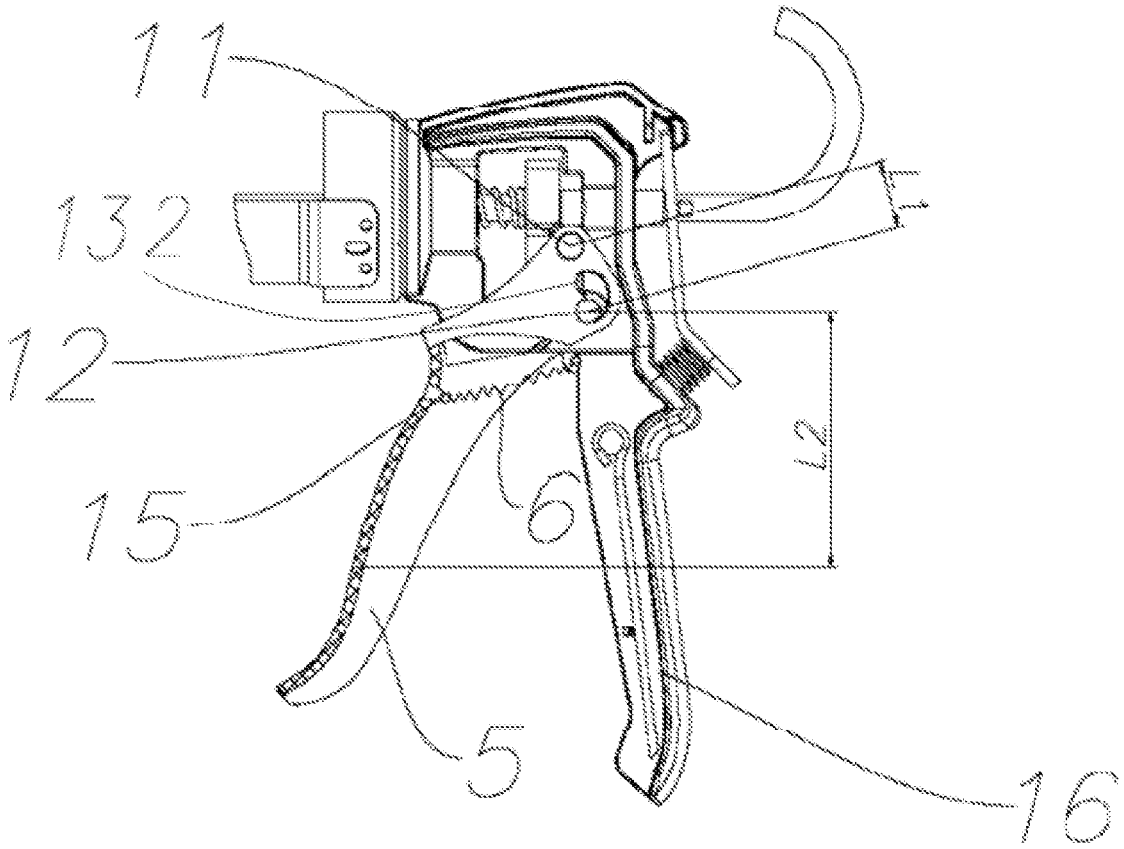
FIG. 3 is a schematic diagram of a first gear in FIG. 1.
Figure 4:
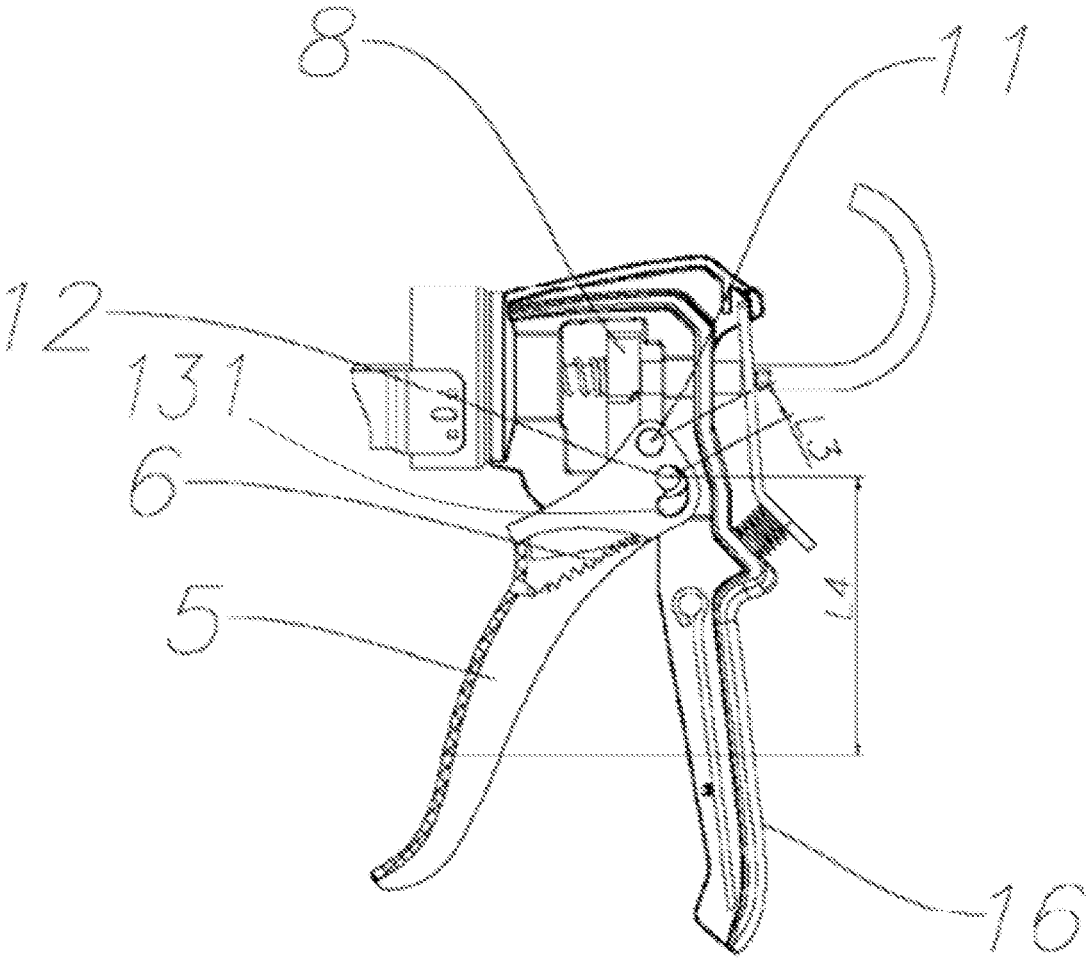
FIG. 4 is a schematic diagram of a second gear in FIG. 1.

FIGS. 3 and 4 show the variation of the spacing between the pivot pin shaft 12 and the actuating member 11 in different gears. When the pivot pin shaft 12 is in the first gear 131, the spacing between the pivot pin shaft 12 and the actuating member 11 is set as L1, and the vertical spacing between the pivot pin shaft 12 and the force applied on the movable handle 5 is set as L2. When the pivot pin shaft 12 is in the second gear 132, the spacing between the pivot pin shaft 12 and the actuating member 11 is set as L3, and the vertical spacing between the pivot pin shaft 12 and the force applied on the movable handle 5 is set as L4. L1 >L3, and L2<L4. When in the first gear 131, the pushing force generated by applying the same force at the movable handle 5 is smaller than that in the second gear 132, and the pushing course is greater than that in the second gear 132. When the movable handle 5 is pulled outwards, the tension spring 6 is lengthened due to the outward pulling force, and the pivot pin shaft 12 will be shifted in the sliding groove 13 to adapt to fluid with a different fluidity.

In other embodiments, the fixed handle 5 is provided with a sliding groove, which is provided with two or more gears. The pivot pin shaft 12 is arranged to be slidable in the sliding groove so as to enable switching between the gears.

Figure 5:
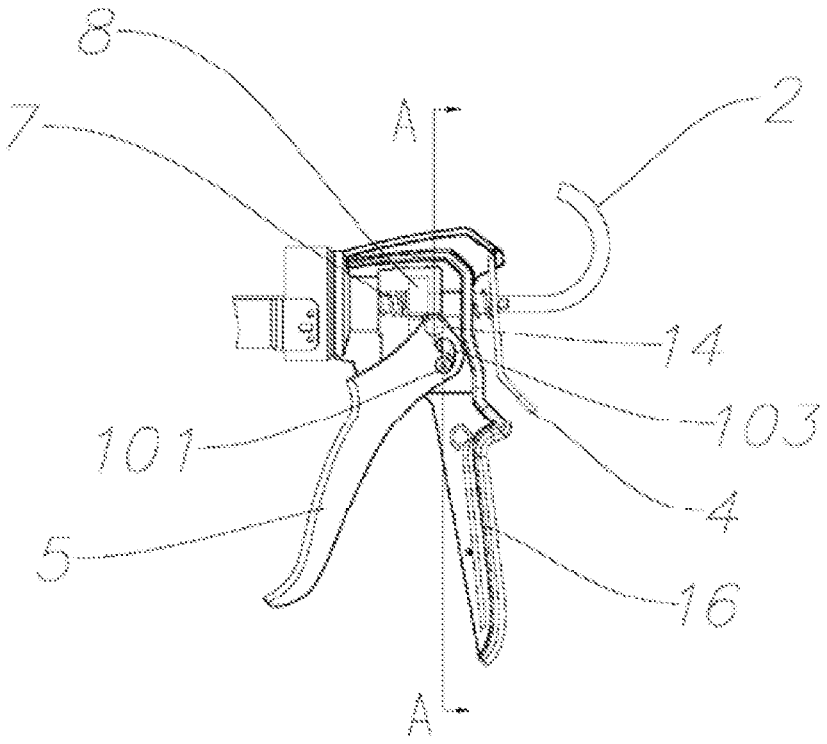
FIG. 5 is a schematic diagram showing the structure of a glue gun according to another preferred embodiment of the present invention.
Figure 6:
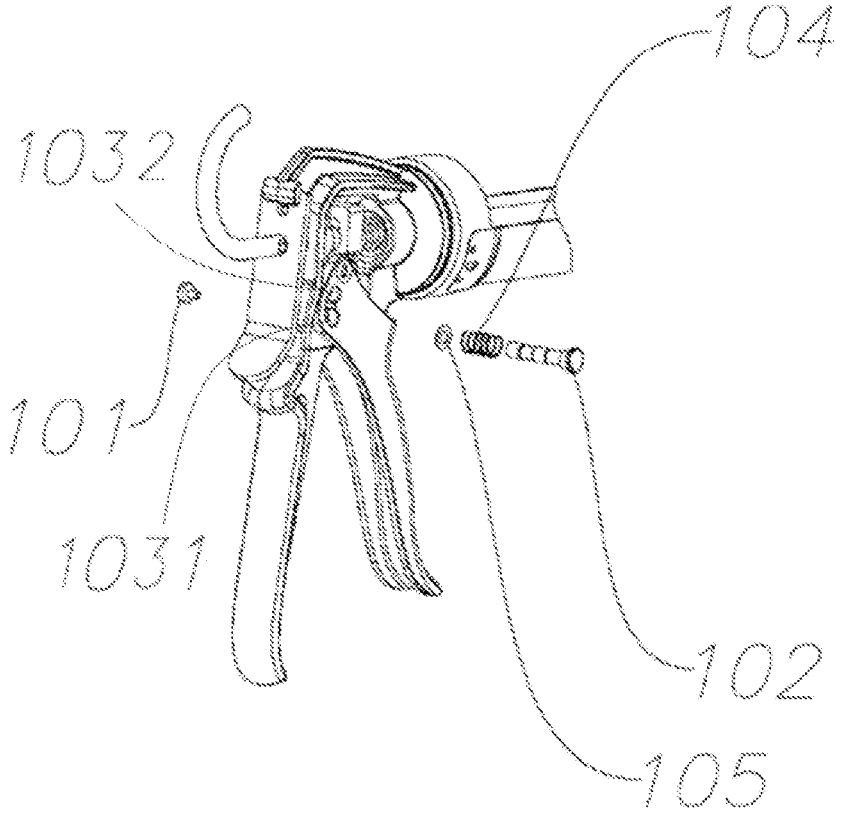
FIG. 6 is an exploded schematic diagram showing a partial structure of the glue gun in FIG. 5.
Figure 7:
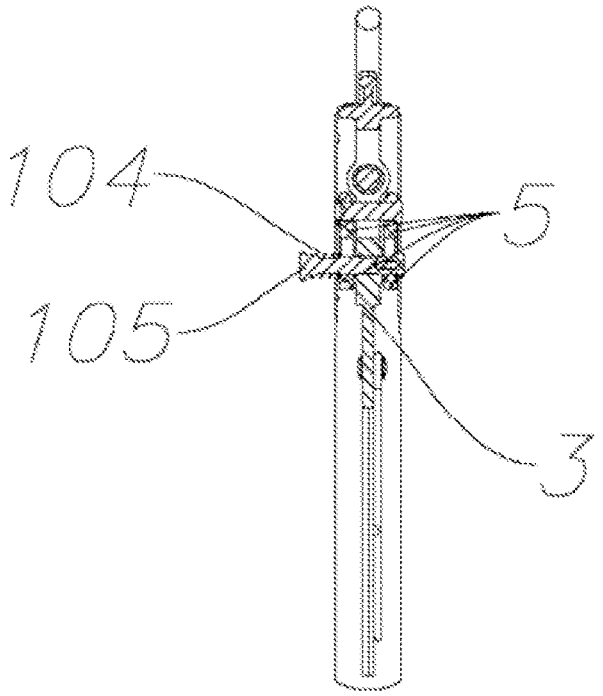
FIG. 7 is an A-A section view of the glue gun in FIG. 5.
Figure 11:
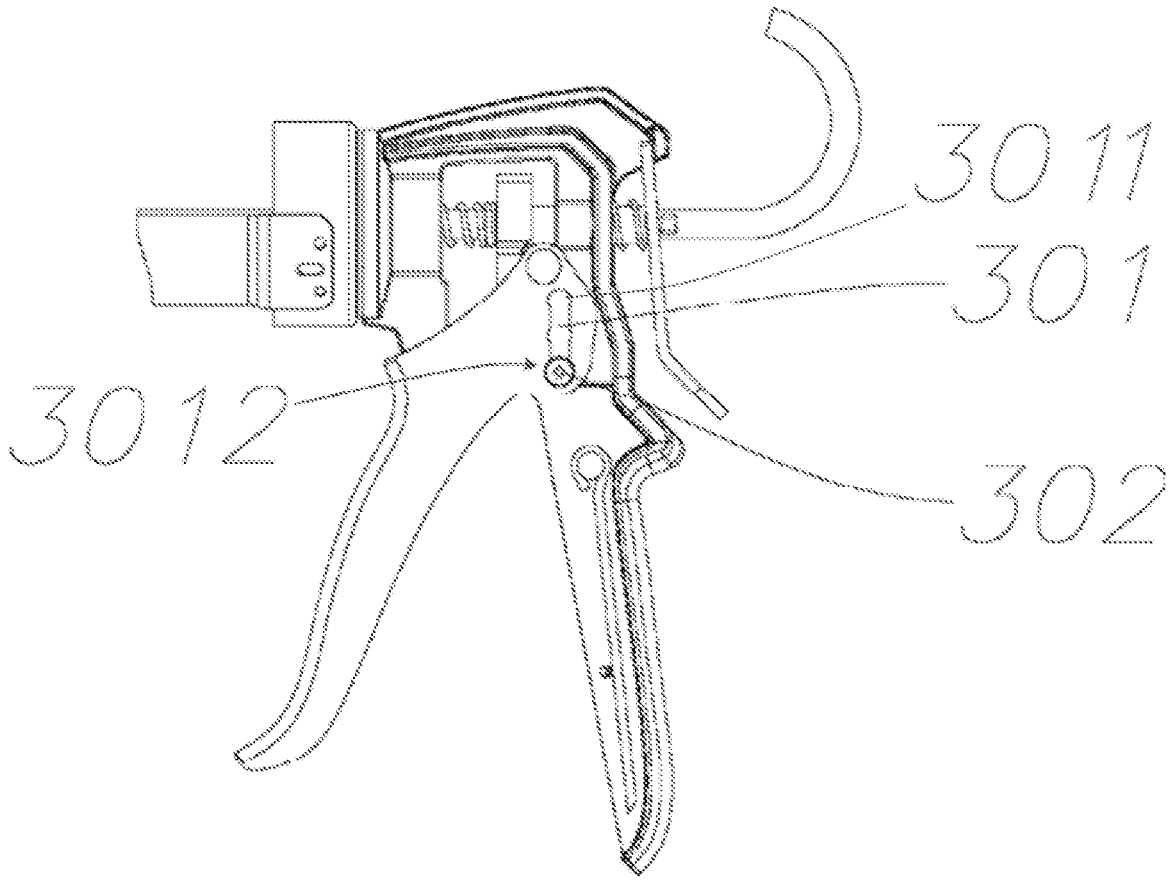
FIG. 11 is a schematic diagram of a glue gun according to another preferred embodiment of the present invention.

In other embodiments, as shown in FIGS. 5-7, the tension spring 6 between the movable handle 5 and the fixed handle 16 is removed. The pivot pin shaft 12 is provided as a stepped pin shaft 102, and the stepped pin shaft 102 has a pressing end and an end fixed to a screw 101. The pressing end is sheathed with a spring 104 and a spacer 105. The stepped pin shaft 102 has a first shaft diameter portion and a second shaft diameter portion. The shaft diameter of the first shaft diameter portion is greater than the width of the sliding groove 103, and the shaft diameter of the second shaft diameter portion is smaller than the width of the sliding groove 103. Under the biasing action of the spring 104, the first shaft diameter portion is in the gear 1031, and when the pressing end is pressed down, the stepped pin shaft moves axially such that the second shaft diameter portion goes into the gear 1031, and at the same time, the second gear 1032 is switched in the sliding groove 103. When the pressing end is released, the stepped pin shaft moves axially in the opposite direction under the action of a restoring force of an elastic component, so that the first shaft diameter portion goes into the gear 1031 again. Preferably, as shown in FIG. 11, the sliding groove 301 is linear and has multiple gears 3011 and 3012, and the stepped pin shaft 302 slides in the sliding groove 301 to realize the switching between the gears 3011, 3012.

Figure 8:
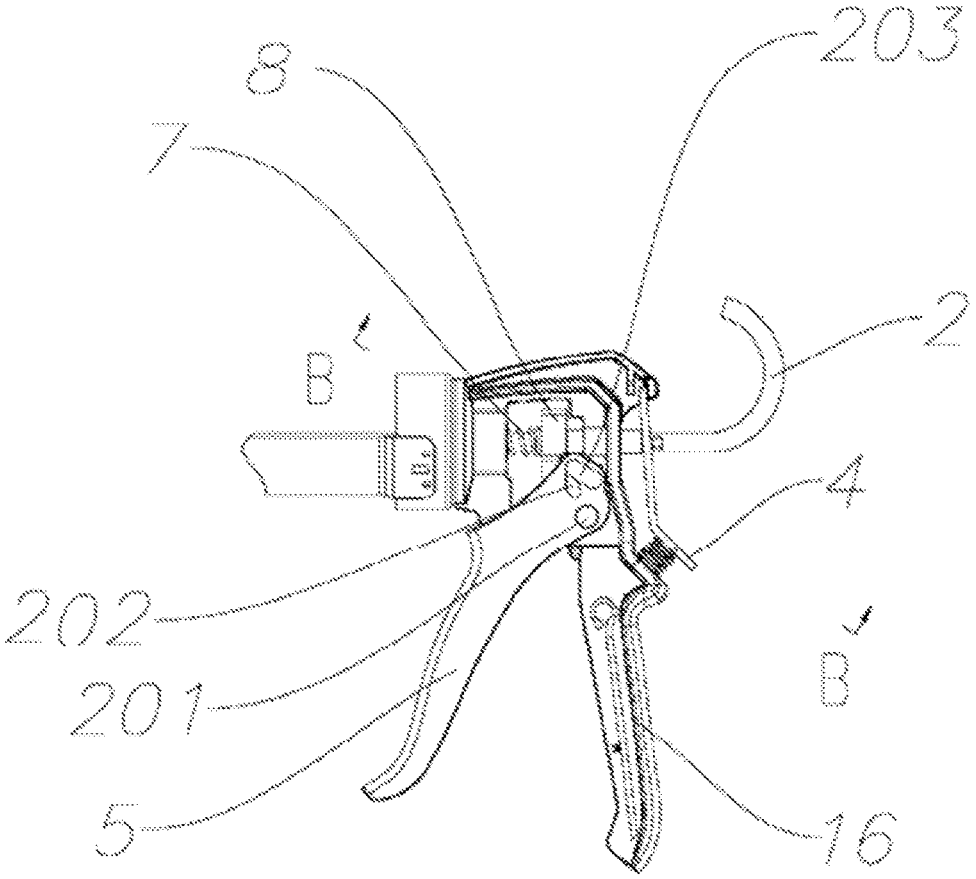
FIG. 8 is a schematic diagram showing the structure of a glue gun according to another preferred embodiment of the present invention.
Figure 9:
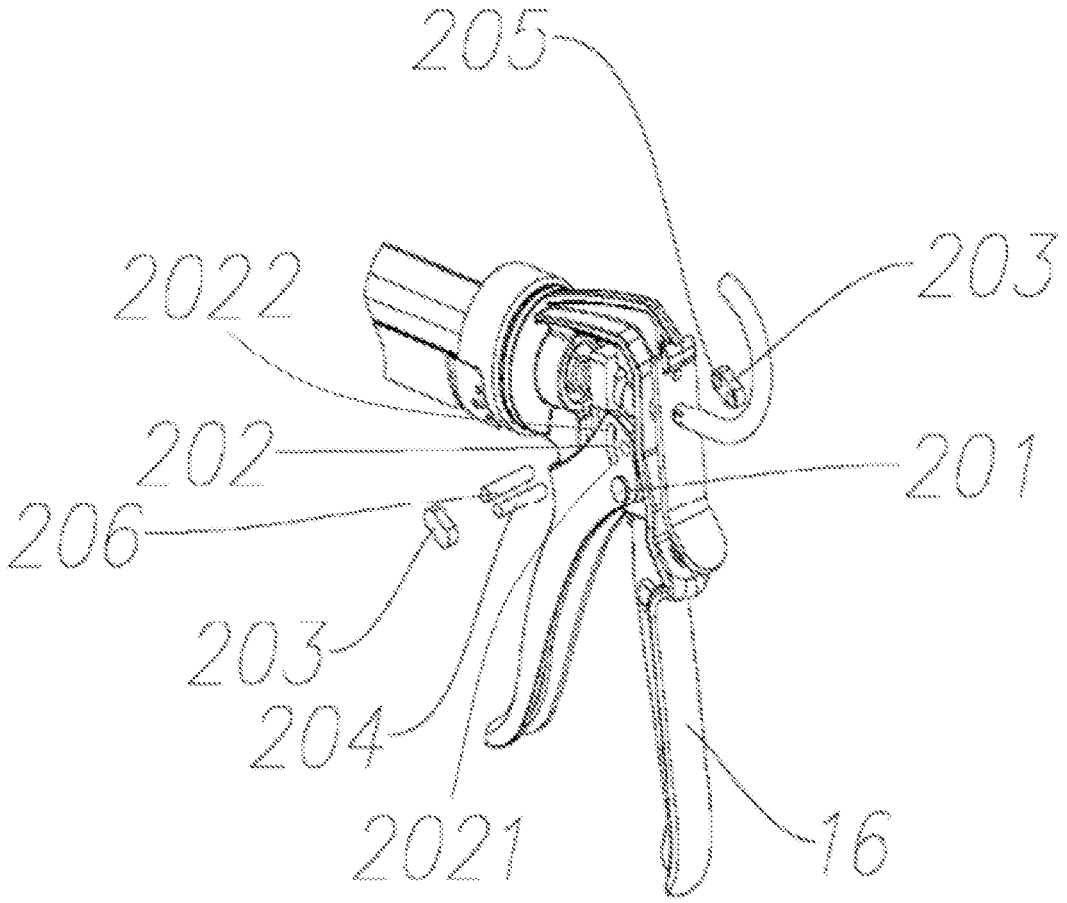
FIG. 9 is a schematic diagram showing a partial structure in FIG. 8.
Figure 10:
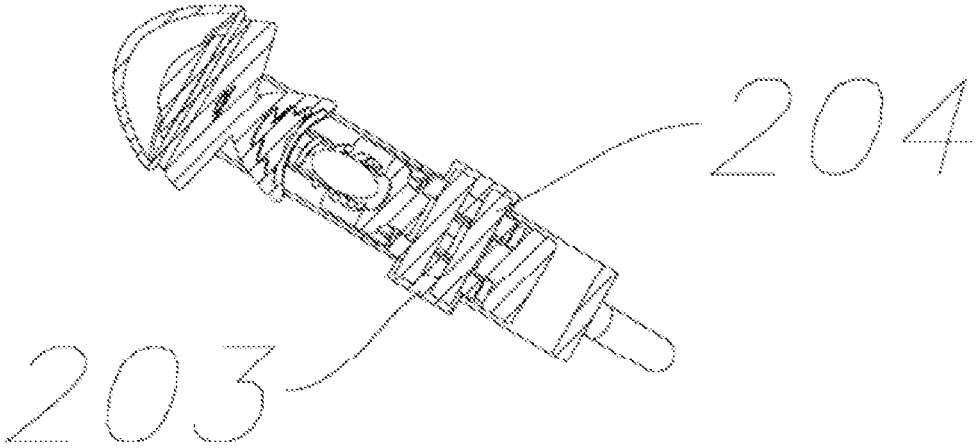
FIG. 10 is a section view of an actuating member in FIG. 8.

FIGS. 8-10 show another preferred embodiment of the present invention. The movable handle 5 is hinged to the fixed handle 16 by means of a pivot pin shaft 201. The movable handle 5 is further provided with a sliding groove 202. The actuating member further comprises a pivot 204 and an actuating part 206 in contact with the push member 8. The actuating part 206 is arranged to be slidable in the sliding groove 202 around the pivot 204. A shift member 203 is connected to the pivot 204 and the actuating part 206, and the actuating part 206 slides between two ends 2021 and 2022 of the sliding groove 202 by means of the shift member 203, i.e. realizing the changes in the position where the pin shaft 206 makes contact with the push member 8 to achieve multiple gears.

The specific preferred embodiments of the present invention are described in detail above. It should be appreciated that a person skilled in the art could make modifications and variations in accordance with the concept of the present invention without involving any inventive effort. Any technical solutions that can be obtained by a person skilled in the art by means of logical analysis, reasoning or limited trials on the basis of the prior art and according to the concept of the present invention should be included within the scope of protection of the claims.

The invention claimed is:

1. A glue gun, wherein the glue gun comprises a movable handle and a fixed handle, and the movable handle is connected to the fixed handle via a pivot pin shaft;

the movable handle is further provided with an actuating member, and the actuating member is provided with an actuating part cooperating with a push member; and a spacing between the pivot pin shaft and the actuating part is sized to be switchable between two or more gears, such that the magnitude of the force applied by the actuating member on the push member is changed;

wherein the fixed handle is provided with a sliding groove, which is provided with two or more gears; and the pivot pin shaft is arranged to be slidable in the sliding groove so as to enable switching between the gears.

2. The glue gun of claim 1, wherein a brake is sheathed on a push rod, one end of the brake cooperates with a limiting groove of a main body, and the one end of the brake moves between a first limiting end and a second limiting end of the limiting groove, so that the push rod has an idle stroke, with a distance from the first limiting end to the second limiting end, in the pushing process.

3. The glue gun of claim 2, wherein the idle stroke is 3-5 mm.

4. The glue gun of claim 1, wherein an elastic component is further provided between the movable handle and the fixed handle; and the elastic component is arranged to produce a pre-tightening force on the movable handle so as to keep the pivot pin shaft in one of the gears.

5. The glue gun of claim 1, wherein the pivot pin shaft is a stepped pin shaft having a pressing end, the pressing end is sheathed with an elastic component, the stepped pin shaft has a first shaft diameter portion and a second shaft diameter portion, the shaft diameter of the first shaft diameter portion is greater than the width of the sliding groove, the shaft diameter of the second shaft diameter portion is smaller than the width of the sliding groove, and the stepped pin shaft is arranged to: under the biasing action of the elastic component, the first shaft diameter portion is in the gear; when the pressing end is pressed down, the stepped pin shaft moves axially such that the second shaft diameter portion to goes into the gear; and when the pressing end is released, the stepped pin shaft moves axially in the opposite direction under the action of a restoring force of the elastic component such that the first shaft diameter portion goes into the gear again.

6. The glue gun of claim 5, wherein the sliding groove is an arc-shaped groove or a linear groove.

7. The glue gun of claim 1, wherein a brake is sheathed on a push rod, one end of the brake cooperates with a limiting groove of a main body, and the one end of the brake moves between a first limiting end and a second limiting end of the limiting groove, so that the push rod has an idle stroke, with a distance from the first limiting end to the second limiting end, in the pushing process.

8. The glue gun of claim 7, wherein the idle stroke is 3-5 mm.

* * * * *